US005335895A

United States Patent [19]

Sell

[11] Patent Number: 5,335,895

[45] Date of Patent: Aug. 9, 1994

[54] SENSING ROPE GUIDE FOR A HOIST DRUM

[75] Inventor: Leslie J. Sell, Bothell, Wash.

[73] Assignee: Ingersoll-Rand Company, Woodcliff Lake, N.J.

[21] Appl. No.: 69,650

[22] Filed: Jun. 1, 1993

Related U.S. Application Data

[63] Continuation of Ser. No. 737,313, Jul. 29, 1991, abandoned.

[51] Int. Cl.[5] ..... B66D 1/48; B66D 1/36

[52] U.S. Cl. ..... 254/271; 254/335; 242/158 R

[58] Field of Search ..... 254/268, 270, 271, 284, 254/333, 335, 374, 417; 242/158 R, 158.2; 212/76

[56] References Cited

U.S. PATENT DOCUMENTS

| | | | |
|---|---|---|---|
| 521,480 | 6/1894 | Sharp | 242/158 R |
| 647,242 | 4/1900 | Sprague | 254/271 |
| 1,782,358 | 11/1930 | Lang | 242/158 R |
| 1,973,446 | 9/1934 | Rosenquist | 242/158 R |
| 3,208,729 | 9/1965 | Townsen | 254/271 X |
| 3,226,090 | 12/1965 | Sauerbrey | 242/158.2 |
| 3,671,016 | 6/1972 | Gladysz | 242/158 R X |
| 4,634,078 | 1/1987 | Kaufmann et al. | 242/158 R |

FOREIGN PATENT DOCUMENTS

| | | | |
|---|---|---|---|
| 112967 | 1/1945 | Denmark | 254/333 |

*Primary Examiner*—Daniel P. Stodola
*Assistant Examiner*—Michael R. Mansen
*Attorney, Agent, or Firm*—Walter C. Vliet

[57] ABSTRACT

A rope hoist rope guide is readily mounted on a drum by a unique split ring construction and includes unique rollers which cooperate with the grooves in the drum to position the guide ring and accurately deploy the rope to appropriately lay the rope in the drum grooves regardless of side forces applied.

9 Claims, 2 Drawing Sheets

SENSING ROPE GUIDE FOR A HOIST DRUM

This application is a continuation of application Ser. No. 07/737,313, filed Jul. 29, 1991, now abandoned.

BACKGROUND OF THE INVENTION

This invention relates generally to rope guides for hoists and the like and more particularly to wire rope hoists having grooved drums. This does not exclude the possible use on other winding machinery that uses rope.

In a typical wire rope hoist installation the hoist assembly, consisting of a winding drum and a means for driving the drum, is mounted in a frame that is suspended on guide wheels which run on the flanges of an 'I' beam. A standard crane hook that hangs on the wire rope below the hoist is the usual means provided for lifting loads.

The hoist is suspended above the work area at heights that often approach and sometimes exceed 100 feet.

Various methods of reeving the hoist to obtain the desired lift capacity and hook travel are employed, the simplest method being 'single reeving' at standard load capacity where the hook moves from end to end of the hoist drum when raising or lowering a load. Another method called 'double reeving' employs a right and left hand grooved hoist drum with the rope attached to one side then looped through a pulley assembly on the hook and attached to the opposite side of the drum. With this method the hook remains in line with the center of the drum throughout its operating height. In addition to these methods of reeving the hoist may also be multi part reeved to increase lifting capacity.

To reduce wear on the rope it is usual to have only one layer on the hoist drum and when multi part lines are used the drum length is increased considerably especially at greater operating heights. When the hoist is suspended parallel to the beam it is often not possible to operate the hoist near a wall or the end of the beam due to the length of drum. For this reason the hoist is sometimes suspended across the beam since its width is considerably less than its length. In this case it is necessary to 'double reeve' the hoist so that load is always on the center of the beam.

Wire rope hoists are designed for vertical lifting only but often the operator will pull sideways to reach a load that is not under the hoist. This can cause the rope to jump the drum grooving causing damage to the rope and imbalance on the hoist particularly when it is suspended across the beam.

The foregoing illustrates limitations known to exist in present rope hoists. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by apparatus for guiding rope on a spiral grooved drum comprising a guide mounting means encircling at least a portion of the drum in cooperation with the drum groove for mounting a rope guide means; a plurality of groove cooperating means on said guide mounting means for rotatably securing said guide means to said drum and for tracking said guide mounting means in spiral advance along said drum in response to rotation of said drum; and said rope guide means being in tangential alignment with said guide mounting means and said drum for maintaining rope played on said drum in tangential alignment perpendicular to said drum.

The foregoing and other aspects will become apparent from the following detailed description of the invention when considered in conjunction with the accompanying drawing figures.

DETAILED DESCRIPTION

Figure 1:
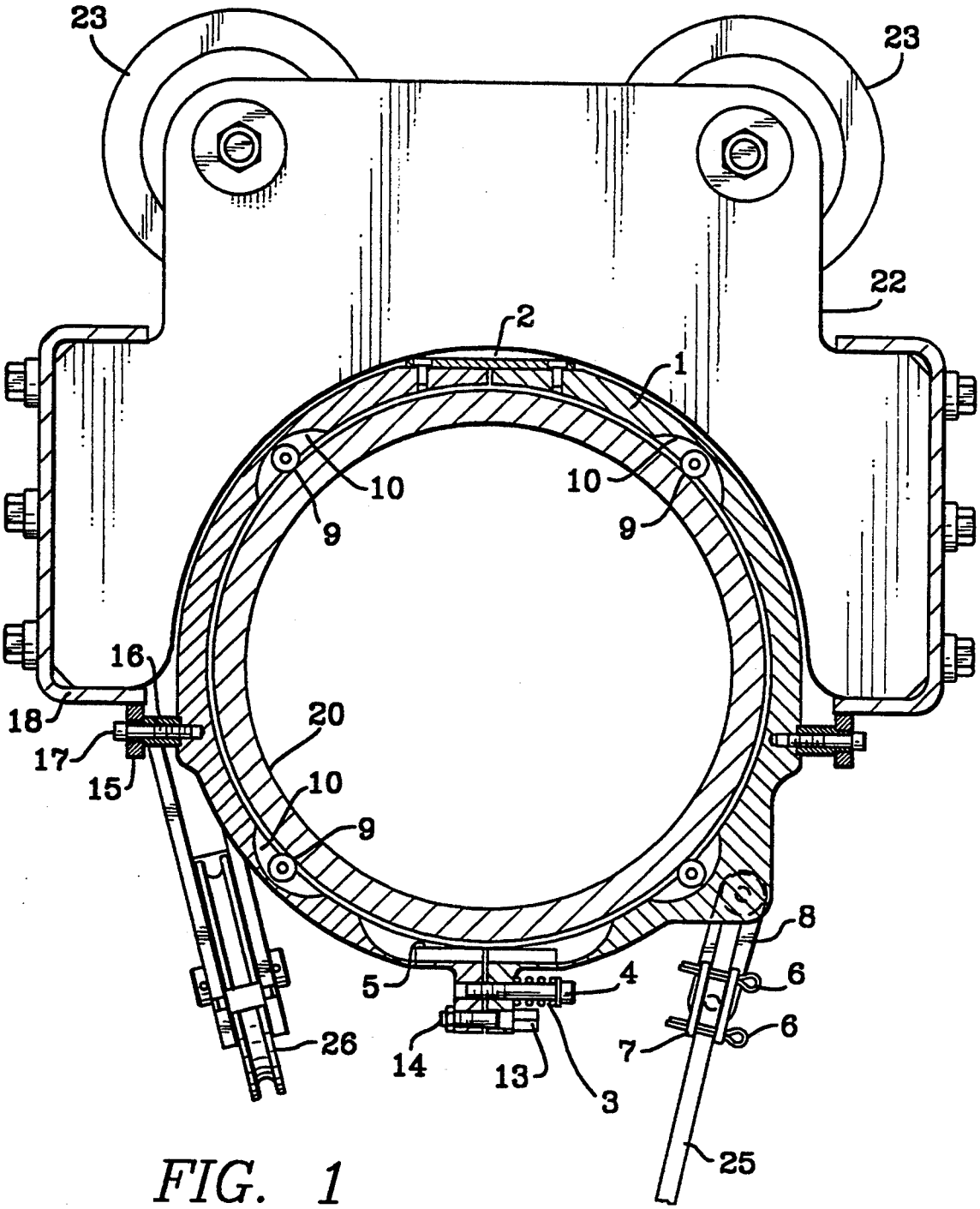
FIG. 1 is a section side elevation view illustrating an embodiment of the rope guide according to the present invention cooperating with a grooved drum in a hoist.

Referring to FIG. 1, the guide mounting means 1 consists of a split steel ring joined at the top by a steel hinge 2 and held together at the bottom by a spring 3 and bolt 4. A key 5 maintains alignment between the ring halves. The guide mounting means 1 is mounted for rotation on a hoist drum 20 which is in turn mounted in driven rotation in a hoist frame 22. The hoist frame 22 in turn may be mounted on a track (not shown) with track or trolley wheels 23 to allow positioning of the hoist over the load.

The wire rope is guided by cotter pins 6 in retainer block 7 that is loosely pivoted from one ring half by arm 8. This allows the rope to move in any direction except sideways.

Four steel groove rollers 9 are housed in identical pockets 10 (two in each half ring) and are free to turn on pins 11 that are pressed through the ring. Each roller is positioned in its pocket by spacers 12. The spacers are all the same thickness which is equal to the pitch of the drum grooving divided by the number of rollers. The groove rollers 9 ride in the hoist drum grooves 21 and cooperate with the groove to align or track the guide and move it along the drum 20 as the drum 20 rotates.

Figure 3:
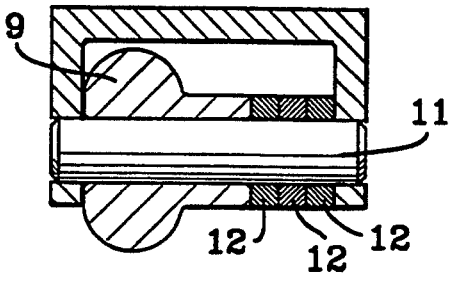
FIG. 3 is a cross section of the detail of the grooved roller for the present invention.

The ring is timed on the drum grooving so the rope 25 is close to the ring at the point that it enters retainer 7. Selecting the pocket nearest to the advance of the drum grooving allows all the spacers to be positioned on one side of a roller (see FIG. 3). Calling this roller #1 and following advance of the drum groove then roller #2 would be positioned with one spacer on the left and two on the right, roller #3 - two spacers on the left and one on the right, roller #4 - all spacers on the left. For opposite hand grooving #1 roller would be positioned in mirror image to FIG. 3 and the spacer sequence would be similar following the advance of the drum groove.

The 'double reeve' balance pulley 26 is suspended from the hoist frame 22 and its position is shown for reference.

Sensing valve 13 located at the bottom of the ring is set by adjusting screw 14.

Reaction rollers 15 are mounted on the side of the ring through adapter 16 and screw 17.

Figure 2:
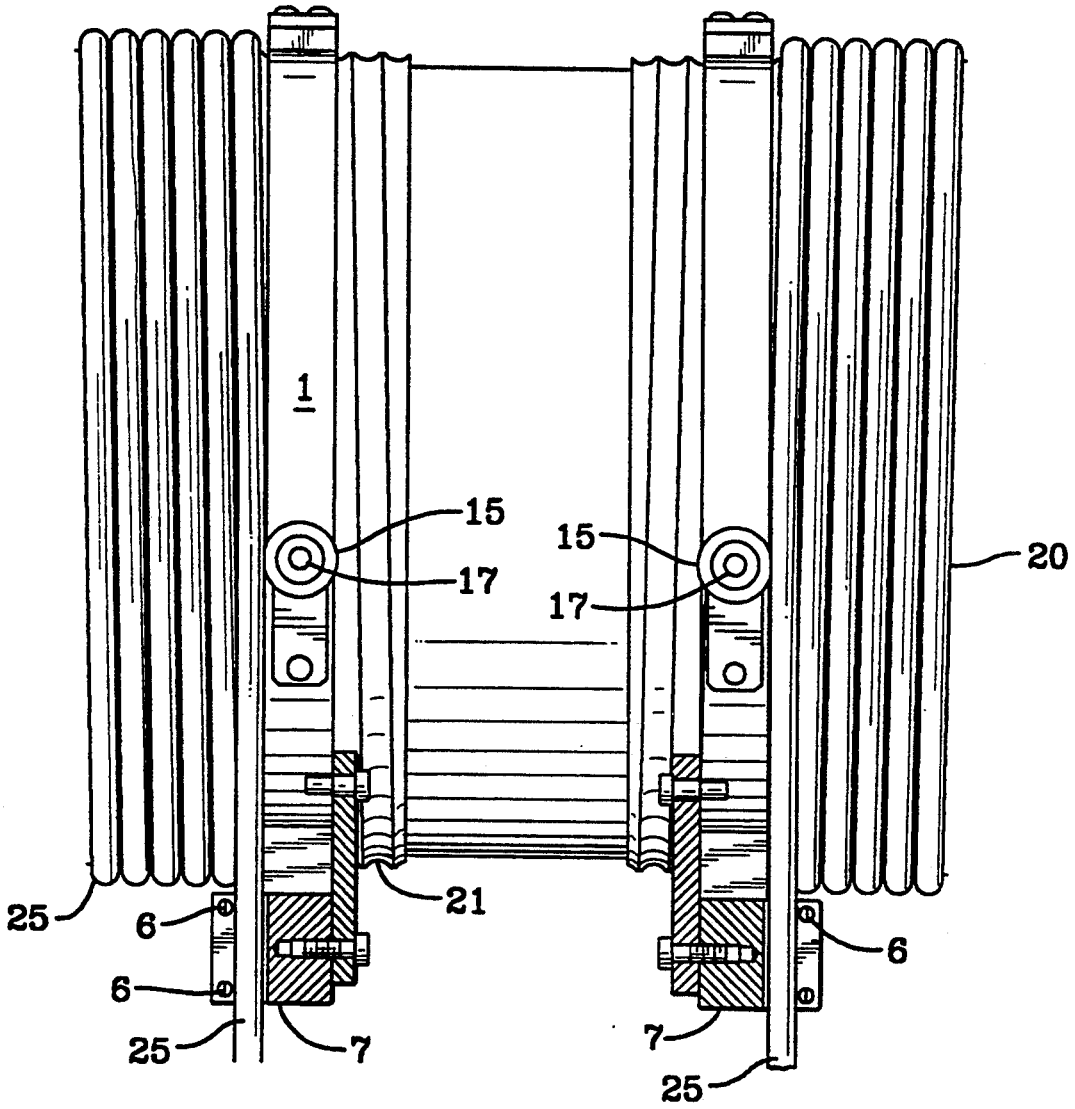
FIG. 2 is a side elevation showing the rope guide according to the present invention cooperating with a grooved rope drum.

Referring to FIG. 2, a cross sectional view of the ring installed on the hoist drum 20 is shown together with a side view showing a typical installation for double reeving using identical components assembled for right and left hand grooving.

Reaction rollers 15 are set to loosely contact the hoist body rails 18 to prevent rotation of the ring and thereby cause the ring to travel with the rope along the hoist drum as it rotates to raise or lower a load.

If the travel of the ring along the hoist drum is impeded by resistance form a side pull acting on the retainer 7 and arm 8 or resistance form some other cause acting at some other point on the ring, the groove rollers 9 will start to cam out of the drum groove causing a radial outward load that eventually overcomes spring 3 and opens the ring slightly at the bottom. This in turn actuates sensing valve 13.

Sensing valve 13 is connected to a pneumatic circuit the logic of which prevents further operation of the hoist in that direction but allows operation in the opposite direction to remove the overload. When two rings are used for double reeved hoists either one may sense and send an overload signal.

Having described the invention, what is claimed is:

1. A rope guide for guiding rope on a spiral grooved cylindrical drum rotating on its axis comprising:

a guide mounting means encircling at least a portion of the drum in cooperation with the drum groove for mounting a rope guide means;

a plurality of groove cooperating means on said guide mounting means for rotatably securing said guide means to said drum and for tracking said guide mounting means in spiral advance along said drum in response to rotation of said drum;

said rope guide means being in tangential alignment with said guide mounting means and said drum for maintaining rope played on said drum in tangential intersection with the circumference of said drum and alignment perpendicular to said axis of said drum;

said guide mounting means further comprising a resilient split ring encircling said drum in rolling contact with a drum groove, said split ring permitting radial expansion of said split ring in response to an unaligned rope causing said split ring to roll out of a drum groove;

means mounted on said guide mounting means for sensing the radial expansion of said split ring;

said split ring being further comprised of two half rings joined at one end by a hinge and resiliently fastened together at its other end by a resilient fastening means; and said resilient fastening means further comprises a means for sensing separation of said split ring.

2. A rope guide according to claim 1, wherein said resilient fastening means further comprises a spring loaded bolt which permits limited separation of said two half rings in response to radial outward loading of said guide mounting means.

3. A rope guide according to claim 1, wherein said means for sensing separation comprises a sensing valve for sensing the condition of separation resulting from an unaligned load condition and providing a signal means for control of said drum operation.

4. A rope guide according to claim 1, wherein said means for sensing separation initiates a signal which in turn prevents further operation of said drum in the progressing direction of operation while allowing reverse operation to correct the unaligned load condition.

5. A rope guide according to claim 1, wherein said groove cooperating means further comprises a plurality of rollers spaced about the circumferential interior of said guide mounting means having longitudinal offset in their location corresponding to the groove pitch of the drum groove whereby said guide mounting means maintains an orientation in a plane perpendicular to the longitudinal axis of the groove drum and is traversed axially along the drum in a direction determined by the direction of rotation of the drum.

6. A rope guide according to claim 5, wherein said rollers are mounted in a pocket on said guide means by means of a shaft pin and positioned within said pocket by spacers having a thickness which is equal to the pitch of the drum groove divided by the number of rollers whereby the positioning of the rollers may be set to the drum pitch by positioning of said spacers on said shaft pin to one side or the other of said roller.

7. A rope guide according to claim 1, wherein said guide mounting means is provided with reaction roller means to prevent rotation of said guide mounting means about the drum.

8. A rope guide according to claim 1, wherein said rope guide means is attached to said guide mounting means in substantially tangential relationship to said guide mounting means and said drum circumference in normal operation.

9. A rope guide means according to claim 8, wherein said rope guide means permits limited radial swing of said rope guide means and limits axial swing whereby forces created by a side pull acting to produce axial swing on the rope guide means are transmitted to said guide mounting means causing said guide mounting means to ride out of the drum groove by a drum groove side camming action and thereby further causing a radial outward face on said guide mounting means.

* * * * *